United States Patent [19]

Ogawa et al.

[11] Patent Number: 4,671,950

[45] Date of Patent: Jun. 9, 1987

[54] HIGH-STRENGTH CARBONACEOUS FIBER

[75] Inventors: Hiroyasu Ogawa; Tetsuro Shigei; Hiroshi Sugeno; Kazuhiro Ichimaru, all of Shizuoka, Japan

[73] Assignee: Toho Beslon Co., Ltd., Tokyo, Japan

[21] Appl. No.: 798,060

[22] Filed: Nov. 14, 1985

[30] Foreign Application Priority Data

Nov. 14, 1984 [JP] Japan ..... 59-238247
Nov. 14, 1984 [JP] Japan ..... 59-238248

[51] Int. Cl.[4] ..... D01C 5/12; D01F 9/12

[52] U.S. Cl. ..... 423/447.1; 423/447.2; 423/447.4; 423/447.6; 264/29.2

[58] Field of Search ..... 423/447.1, 447.4, 447.6, 423/447.2; 264/29.2

[56] References Cited

U.S. PATENT DOCUMENTS

| | | | |
|---|---|---|---|
| 3,027,222 | 3/1962 | Wilkinson | 423/447.6 |
| 3,454,362 | 7/1969 | Spry | 423/447.2 |
| 3,841,079 | 10/1974 | Ram et al. | 264/29.2 |
| 4,024,227 | 5/1977 | Kishimoto et al. | 423/447.4 |
| 4,073,870 | 2/1978 | Saji et al. | 423/447.6 |
| 4,526,770 | 7/1985 | Pepper et al. | 264/29.2 |

FOREIGN PATENT DOCUMENTS

| | | | |
|---|---|---|---|
| 59-106521 | 6/1984 | Japan | 264/29.2 |
| 59-137512 | 8/1984 | Japan | 264/29.2 |
| 2138114 | 10/1984 | United Kingdom | 264/29.2 |

*Primary Examiner*—John Doll
*Assistant Examiner*—Robert M. Kunemund
*Attorney, Agent, or Firm*—Sughrue, Mion, Zinn, Macpeak & Seas

[57] ABSTRACT

A carbonaceous fiber having a carbon content of from 70 to 90%, a high tensile strength and a high modulus of elasticity, which is produced by a method which comprises preoxidizing an acrylic fiber in an oxidizing atmosphere at a temperature of from 10° to 60° C. below the decomposition point of said fiber, to prepare a preoxidized fiber having a degree of orientation of not less than 78% at an angle of X-ray diffraction ($2\theta$) of 25° and a specific gravity of from 1.30 to 1.40, pyrolyzing the preoxidized fiber in an inert gas atmosphere by passing the fiber firstly through a lower temperature zone having a temperature of not higher than 750° C. and then through a higher temperature zone having a temperature of from 750° to 950° C., during the pyrolysis controlling the tension of the fiber so that the change of the fiber length during pyrolyzing is from +16% to −8.8% based on the length of the preoxidized fiber.

21 Claims, 3 Drawing Figures

HIGH-STRENGTH CARBONACEOUS FIBER

FIELD OF THE INVENTION

The present invention relates to an economical high-performance carbonaceous fiber with a carbon content of from 70 to 90% by weight. The carbonaceous fiber of the present invention is suitable for use in reinforced products, composite materials, and tire cords.

BACKGROUND OF THE INVENTION

Carbon fibers with carbon contents of about 95% by weight or higher exhibit tensile strength of 300 kg/mm$^2$ or more and 20,000 kg/mm$^2$ or more. Thus, they are usefully processed into fiber strands or chopped fibers, and are used in combination with various matrices such as thermosetting or thermoplastic polymers. The resulting composites are extensively used in the field of aircraft, automotive and sporting goods. When carbon fibers are prepared by preoxidation and carbonization using acrylic fiber as a precursor, a weight loss of from 45 to 50% usually occurs during pyrolysis and the fiber production requires temperatures higher than 1,000° C. in an inert gas atmosphere. This weight loss and the high temperatures used lead to increased materials and energy costs. In addition, because of the need for using a furnace adapted to operations at temperatures over 1,000° C. and a special refractory material capable of withstanding such high temperatures, high initial investment costs are involved, and this results in raising the price of the carbon fibers obtained. In spite of their high cost, conventional carbon fibers, having excellent physical properties and quality, are extensively used in industrial fields where quality is a predominant factor, but not in fields where low cost is of primary importance.

Carbonaceous fibers with carbon contents of 90% by weight or less are conventionally obtained as intermediates for the production of carbon fibers and are less costly than the carbon fibers which form the final product. On the other hand, carbonaceous fibers typically have such poor physical properties that, in comparison with carbon fibers, the cost performance of carbonaceous fibers is too poor to provide an incentive for using them in many fields. In other words, if the physical properties of carbonaceous fibers can be improved, their use in cost-conscious fields currently dominated by carbon fibers will be increased.

It has been described that carbonaceous fibers can be produced by stretching preoxidized fibers in an inert gas atmosphere at temperatures between 350° and 500° C., or between 400° and 800° C., and further carbonized at temperatures higher than 800° C. (see Japanese Patent Application (OPI) Nos. 147222/79 and 63012/81). However, the carbonaceous fibers produced by these methods do not have fiber performance comparable to that of carbon fibers.

With a view to improving the performance of carbonaceous fibers, the present inventors made detailed studies on the starting materials and the manufacturing process involving preoxidation and pyrolysis steps. As a result, the present inventors have found that their object can be attained by setting specific conditions for each of the preoxidation and pyrolysis steps, as well as by combining the two steps in a systematic way. The present invention has been accomplished on the basis of this finding.

SUMMARY OF THE INVENTION

The primary object, therefore, of the present invention is to provide a carbonaceous fiber that has a tensile strength of not less than 250 kg/mm$^2$ and modulus of elasticity of not less than 15,000 kg/mm$^2$.

The carbonaceous fiber of the present invention has a carbon content of from 70 to 90% by weight, a tensile strength of not less than 250 kg/mm$^2$ and a modulus of elasticity of not less than 15,000 kg/mm$^2$. This fiber is produced by a method which comprises preoxidizing an acrylic fiber in an oxidizing atmosphere at a temperature of from 10° to 60° C. below the decomposition point of said fiber to prepare a preoxidized fiber having a degree of orientation of not less than 78% at an angle of X-ray diffraction ($2\theta$) of 25° and a specific gravity of from 1.30 to 1.40; and pyrolyzing the preoxidized fiber until the carbon content of the fiber becomes a definite content in an inert gas atmosphere by passing the fiber firstly through a lower temperature zone having a temperature of not higher than 750° C. and then through a higher temperature zone having a temperature of from 750° to 950° C., and during the pyrolysis controlling the tension of the fiber so that the change of the fiber length during pyrolyzing is from +16% to −8.8% based on the length of the preoxidized fiber.

DETAILED DESCRIPTION OF THE INVENTION

Figure 1:
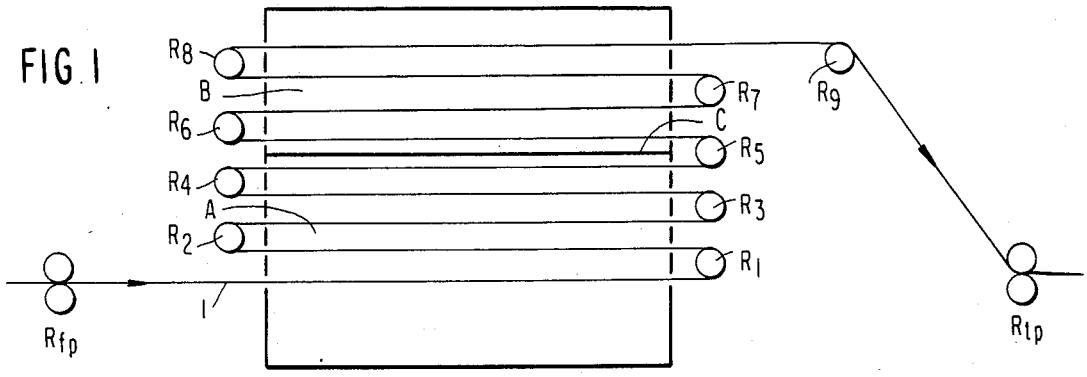
FIG. 1 is a sketch of one embodiment of a preoxidizing apparatus that can be used in producing the carbonaceous fiber of the present invention.

The acrylic fiber used as the starting material for producing the carbonaceous fiber of the present invention is preferably composed of at least 93% by weight of acrylonitrile. Preferably, the acrylic fiber used in the present invention is a copolymer of at least 93% by weight acrylonitrile and any known comonomer commonly used in the production of acrylic fibers, such as methyl acrylate, acrylamide, acrylic acid, or a salt thereof, itaconic acid, methallylsulfonic acid, or a salt thereof, such as a sodium or ammonium salt. A homopolymer of acrylonitrile may be used, but for the purpose of producing carbonaceous fibers of high performance, acrylic fibers comprising of at least 95% by weight acrylonitrile and from 1 to 5% by weight methyl acrylate, and optionally from 0.1 to 0.5% by weight sodium methallylsulfonate, or from 0.5 to 1% by weight itaconic acid, are particularly preferred.

The individual filaments in the acrylic fibers preferably have a fineness in the range of from 0.1 to 1.0 denier. If the filament fineness is less than 0.1 denier, the frequency of problems due to fluffing during preoxidation tends to increase. If the fineness is more than 1.0 denier, the reactions for preoxidation will not proceed uniformly and the carbonaceous fibers obtained have low strength.

The copolymer or homopolymer of acrylonitrile preferably has a molecular weight of from $3\times10^4$ to $1\times10^5$, and the range of from $5\times10^4$ to $8\times10^4$ is particularly advantageous for the purpose of providing high-performance carbonaceous fibers.

The acrylic fiber is conventionally prepared by spinning a solution of the copolymer or homopolymer of acrylonitrile in a good solvent therefor, such as concentrated aqueous solution of zinc chloride, dimethylformamide, sodium thiocyanate, dimethylacetamide, or dimethyl sulfoxide. The wet process using a concentrated aqueous solution of zinc chloride, and the process where the filaments are coagulated after extrusion into air has the advantage that they have a greater tendency for providing high-performance carbonaceous fibers.

One feature of the present invention is to use an acrylic fiber preferably having a degree of orientation of not less than 85%, and more preferably not less than 90%, as measured at an angle of X-ray diffraction ($2\theta$) of 17°. The degree of orientation is determined by the formula $(90-W_{\frac{1}{2}})/90\times 100$ (%), wherein $W_{\frac{1}{2}}$ is one half of the difference between the intensity of X-ray diffraction for $\phi=90°$ and that for $\phi=0°$ on an intensity vs. $\phi$ angle graph for $2\theta=17°$ or $2\theta=25°$. X-ray diffractometry is conducted with an X-ray diffractometer of Rigaku Denki Co., Ltd. in accordance with the method described in the Appendix of *Tanso Seni* (Carbon Fibers), 1st ed., by Ohtani et al., published by Kindai Henshusha, pp. 375-383.

One method for obtaining acrylic fiber having a degree of orientation of not less than 85% consists of the following steps: gelled filaments obtained by spinning a polymer solution is washed to remove the solvent and then dried at from 120° to 150° C. to increase their density; then, the densified filaments are stretched to an extent of from 90 to 95% of maximum draw ratio in saturated steam at a temperature of from 110° to 130° C. If the degree of orientation of the acrylic fiber is less than 90%, it is difficult to provide a preoxidized fiber having a degree of orientation of 78% or higher, and the chance that the finally obtained carbonaceous fiber will have a low performance is increased. The maximum draw ratio $=(l_2-l_1)/l_1\times 100$, wherein $l_1$ is the original fiber length, $l_2$ is the fiber length after stretched to a break point.

For preventing coalescence of the fibers during preoxidation, an oiling agent may be applied to acrylic fiber, preferably, after the washing (prior to the drying) or after the drying (prior to the stretching in steam). It is especially preferable to apply the agent after the washing.

Any conventional oiling agent may be used in the present invention. Examples of oiling agents include an aliphatic polyoxyalkylene compound or a quaternary ammonium salt thereof or a compound represented by formula (I), (II) (which are disclosed in U.S. Pat. No. 4,536,448) or (III) shown hereinbelow.

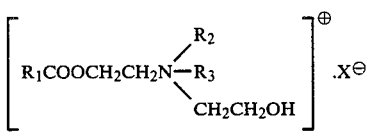

(I)

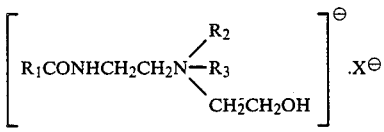

(II)

$$C_nH_{2n+1}COO(CH_2CH_2O)_pH \quad \text{(III)}$$

In these formulae, $R_1$ is an aliphatic hydrocarbon group having from 11 to 17 carbon atoms, and preferably is a linear saturated aliphatic hydrocarbon group; $R_2$ and $R_3$ are hydrogen, a lower alkyl group preferably having from 1 to 3 carbon atoms such as methyl and ethyl groups, hydroxyethyl group and hydroxyisopropyl group; X is an anion, such as chlorine ion, acetate ion, lactate ion, phosphate ion, sulfate ion, borate ion, nitrate ion, and phosphoryl dioxy ethanol ion; and n is an integer of from 9 to 18 and p is an integer of from 10 to 50.

The oiling agent is applied to acrylic fibers preferably in an amount of not less than 0.01% by weight, more preferably from 0.05 to 10% by weight, based on the weight of the fiber having the agent.

For applying an oiling agent to acrylic fibers, the fibers are immersed in a 0.1-10% by weight aqueous solution or dispersion of an oiling agent. Alternatively, the same aqueous solution or dispersion may be sprayed onto the acrylic fiber filaments. The appropriate temperature of the aqueous solution or dispersion of the polysiloxane compound is within the range of from 15° to 50° C. The appropriate period of time for immersion of the acrylic fiber in the aqueous solution or dispersion of the oiling agent is from 1 to 100 seconds. A period of from 1 to 10 seconds is preferred if the immersion is conducted after the solvent for spinning is removed from the fiber by washing, and a period of from 10 to 40 seconds is preferred if the immersion is conducted for dried and densified filaments.

After removing the solvent from filaments by washing, the filaments (either having the oiling agent or having no oiling agent) are preferably dried in two stages, the first stage consisting of heating at from 70° to 90° C. for from 30 to 120 seconds until the moisture content of the filaments is reduced to from 5 to 10% by weight based on the weight of the filaments, and the second stage consisting of heating at from 120° to 140° C. to attain a moisture content of 1% or less. When the compound is applied to the fiber after the drying, the fiber is not necessary to subject to further drying.

The acrylic fiber used as the starting material for producing the carbonaceous fiber of the present invention is generally used as a strand comprising from 100 to 100,000 filaments. Such an acrylic fiber strand is heated in an oxidizing atmosphere such as air under tension at a temperature of from 10° to 60° C. below the decomposition point of the fiber until the specific gravity of the fiber comes to be within the range of from 1.30 to 1.40. If the specific gravity of the preoxidized fiber is less than 1.30, not only is the chance of fiber breakage in the subsequent pyrolyzing step increased, but also a large amount of generated gas will be evolved. If the specific gravity of the preoxidized fiber is more than 1.40, the fiber cannot be sufficiently stretched upon pyrolysis to provide a carbonaceous fiber having a high strength and modulus of elasticity. The preoxidation is performed preferably at from 200° to 300° C., and more preferably at from 200° to 300° C. and from 30° to 60° C. below the decomposition point of the acrylic fiber. If the preoxidation temperature is excessively high and has a difference of less than 10° C. from the decomposition point of the starting acrylic fiber, the two reactions occurring in the preoxidation step, i.e., the reaction between the fiber and oxygen and the cyclizing reaction of nitrile groups in the polymer, will proceed unevenly in the radial direction of the fiber. If the temperature difference is greater than 60° C., the preoxidation process requires a prolonged time. The preoxidation temperature is generally experimentally selected at such a value that the desired preoxidized fiber is obtained in a period of from 0.3 to 1 hour.

In order to obtain the carbonaceous fiber of the present invention, the degree of orientation of the preoxidized fiber at an angle ($2\theta$) of 25° that will increase with the progress of peroxidation must finally be not less than 78%, and preferably not less than 80%. If the degree of orientation finally reached is less than 78%, the carbonaceous fiber obtained has a low modulus of elasticity. The conditions necessary for obtaining a degree of orientation of at least 78% will vary with the comonomer content of the acrylic fiber, but the tension to be applied to the preoxidation step is preferably in the range of from 70 to 200 mg/denier, and more preferably from 100 to 150 mg/denier and the temperature is preferably set at a value that ensures uniform progress of the preoxidation reactions. Such a temperature can be determined experimentally.

An embodiment of the preoxidizing furnace that may be used in producing the carbonaceous fiber of the present invention is shown schematicaly in FIG. 1. As shown, the fiber strand 1 is guided by a feed roller Rfp into the furnace, and after being transported via multiple rollers $R_1$ to $R_9$, the strand is taken up by a roller Rtp.

Figure 2:
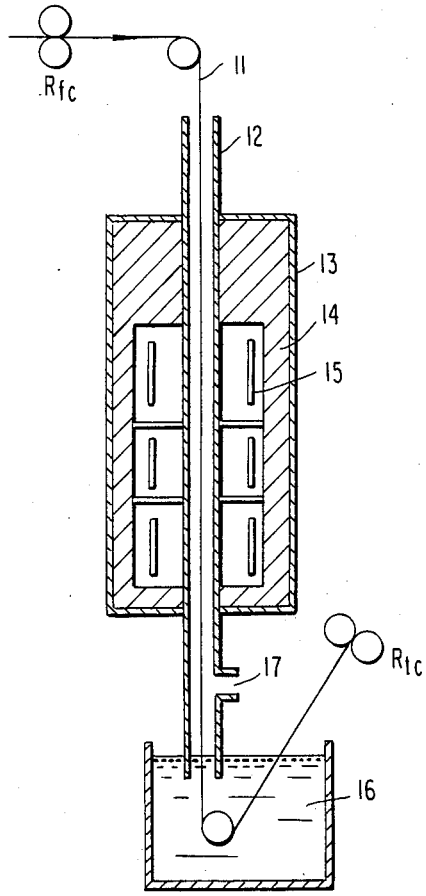
FIGS. 2 and 3 are sketches of two embodiments of the pyrolyzing apparatus used in the production of the carbonaceous fiber of the present invention.

The preoxidized fiber is then pyrolyzed by passing the fiber firstly through a lower temperature zone which may have an ascending temperature gradation. The temperature of the lower temperature zone is more than 280° C. and not higher than 750° C. When the lower temperature zone have an ascending temperature gradation, the temperature is raised preferaby in a degree of from 1° to 50° C. per second, more preferably from 5° to 20° C. per second. During the pyrolysis, the tension of fiber is controlled so that the change of the fiber length to be of from +16% to −8.8%, preferably from +10% to −2%, based on the preoxidized fiber. The necessary tension for controlling the change of the fiber length to be within the above-described length is from 150 to 250 mg/denier. The heating time of fiber at the lower temperature zone is usually from 0.1 to 10 minumtes preferably form 0.2 to 6 minutes and more preferably from 0.5 to 3 minutes. At the lower temperature zone the fiber is preferably heated until the necessary stretching ratio is attained. The necessary stretching is determined according on the necessary shrinkage of fiber during the pyrolysis at the higher temperature zone. The pyrolysis may be conducted using a furnace as shown in FIG. 2, which is explained in Examples hereinafter. In order to produce a carbonaceous fiber having particularly high strength (more than about 300 kg/mm$^2$) and modulus of elasticity (more than about 20,000 kg/mm$^2$; without fluffing), the preoxidized fiber is first stretched at a temperature of from 300° to 550° C. in a degree of from 40 to 75% of the maximum draw ratio of the fiber at the heating temperature at the lower temperature zone. The fiber is preferably heated at temperature of from 300° to 550° C. (which may have ascending temperature gradation) for a period of from 0.2 to 6 minutes, and more preferably 0.5 to 3 minutes. Then, the pyrolysis step is completed by heating the fiber at a temperature of from 750° to 950° C. while providing shrinkage in a degree of from 40 to 80% of the free shrinkage. In order to perform pyrolysis by this scheme, the preoxidized fiber is successively passed through an independent furnace having a heating zone for from 300° to 550° C. and another independent furnace having a heating zone for from 750° to 950° C. (see FIG. 3). The expression "free shrinkage" means the ratio of fiber shrinkage under a load of 1 mg/denier to the initial fiber length as shown below.

$$\text{Free shrinkage} = \frac{l_1 - l_2}{l_1} \times 100\ (\%)$$

wherein $l_1$ is the initial fiber length and $l_2$ is the fiber length after shrinking of the fiber.

As mentioned above, the stretching in the heating zone having a temperature of from 300° to 550° C. is performed until the fiber is stretched to an extent of from 40 to 75% of the maximum draw ratio of the fiber at that temperature, and the preferred range is from 50 to 70% of the maximum draw ratio. If the fiber is stretched to less than 40% of the maximum draw ratio, a carbonaceous fiber having lower strength and modulus of elasticity is obtained. If the fiber is stretched to more than 75% of the maximum draw ratio, filament breakage increases.

In the heating zone of from 750° to 950° C., the fiber is caused to shrink to an extent of from 40 to 80% of the free shrinkage. When shrinkage is less than 40% of the free shrinkage, the chance of filament breakage is increased. When shrinkage exceeds 80% of the free shrinkage, a carbonaceous fiber having lower strength and modulus of elasticity will result. The pyrolyzing time period should be properly determined depending on the case, and treatment at a temperature of from 750° to 950° C. is preferably continued for 0.5 minute or longer. If the time of period of treatment at this temperature is less than 0.5 minute, a carbonaceous fiber of low strength will tend to result. The pyrolysis is continued until the carbon content of the fiber becomes, within the range of from 70 to 90% by weight.

By performing pyrolysis in the manner described above, a carbonaceous fiber having a carbon content of from 70 to 90% by weight, a strength of 250 kg/mm$^2$ or higher, and a modulus of elasticity of 15,000 kg/mm$^2$ or more can be obtained.

The carbonaceous fiber of the present invention has high strength and a high modulus of elasticity as well as high affinity for water. Furthermore, it can be manufactured with inexpensive facilities with a high yield of pyrolysis. Therefore, the carbonaceous fiber produced in accordance with the present invention excells that of conventional carbon fibers in an economical point of view, and will contribute to an expanded use of carbonaceous fibers in various industrial fields.

The carbonaceous fiber of the present invention is suitable for reinforced product, composite materials, and tire cords.

In order to produce a carbonceous fiber having a particularly high affinity for water, the acrylic fiber is preoxidized and carbonized in such a manner that the moisture regaine of the final product is not less than 0.5 wt%. The expression "moisture regaine" of a carbonaceous fiber means the equilibrium moisture regaine obtained by drying the fiber at 105° C. for 30 minutes and then leaving the fiber standing for one week at 20° C. in a container having a relative humidity of 80% (such a humidity can be obtained by using a saturated aqueous solution of ammonium chloride). This moisture regaine is determined by the following equation:

Moisture Regaine =

-continued $$\frac{\text{Fiber weight after standing} - \text{Fiber weight after drying}}{\text{Fiber weight after drying}} \times 100\ (\%)$$

A carbonaceous fiber having a saturated water content of 0.5% by weight or more can be obtained by preoxidizing the acrylic fiber to provide a specific gravity of 1.35 or higher, and then pyrolyzing the preoxidized fiber at a temperature of 900° C. or less.

The carbonaceous fiber thus obtained in accordance with the present invention has a high affinity for water and high strength and a high modulus of elasticity, and exhibits a performance comparable to that of carbon fibers. Because of this high performance, the carbonaceous fiber of the present invention is useful in the fabrication of a tire cord that is sufficiently impregnated with a resorcinformalin latex (RFL) which is used for production of tire cord to exhibit a high cord strength.

The carbonaceous fiber of the present invention is also highly suitable for incorporation in products that are manufactured with water being used as a medium; for example, the fiber may be mixed with pulp to make composite paper, or may be blended with cement to increase its strength. Since the carbonceous fiber of the invention has a performance comparable to that of carbon fibers, it is also useful as a plastic-reinforcing material.

If desired, the carbonaeceous fiber of the present invention may be further carbonized at temperatures not lower than 1,000° C., typically between 1,000° and 3,000° C., to produce carbon fibers that will perform better than the conventional carbon fibers.

The following examples and comparative examples are provided for the purpose of further illustrating the present invention. Unless otherwise indicated, all percents and parts given hereunder are on the basis of weight.

EXAMPLES 1 TO 3 AND COMPARATIVE EXAMPLE 1

A 10% solution of copolymer (molecular weight: 60,000) of 97% acrylonitrile and 3% methyl acrylate using a 60% concentrated aqueous solution of zinc chloride as a solvent was extruded through a spinneret nozzle (0.05 mmϕ×6,000 holes) into a coagulating bath having the same components as the solvent and containing 28% zinc chloride. The extruded filaments were washed with water to remove the solvent and treated with an oiling agent made of a quaternary ammonium hydrochloride of an ester of dihydroxyaminoethylstearic acid to deposit the oiling agent to the fiber in an amount of 0.5% of the weight of the treated filaments. The filaments were then dried at 120° C. to increase their density, and stretched in saturated steam at 120° C. to attain a total draw ratio of 15/1. The resulting acrylic fiber strand consisted of 6,000 filaments with a fineness of 1.0 denier. The fiber had a degree of orientation of 91% at an angle (2θ) of 17° and decomposed at 287° C. in air. This fiber strand was introduced into a preoxidizing furnace (255° C., see FIG. 1) via a supply roller Rfp and treated for various time periods and under varying tensions. The degrees of orientation of the preoxidized fibers at an angle (2θ) of 25° and their specific densities are shown in Table 1. Referring to FIG. 1, the preoxidizing furnace consisted of a first preoxidizing zone A, a second preoxidizing zone B, a partition wall C, feed roller Rfp, take-up roller Rtp, and transport rollers $R_1$ to $R_9$. In FIG. 1, the fiber strand is indicated by 1.

Figure 3:
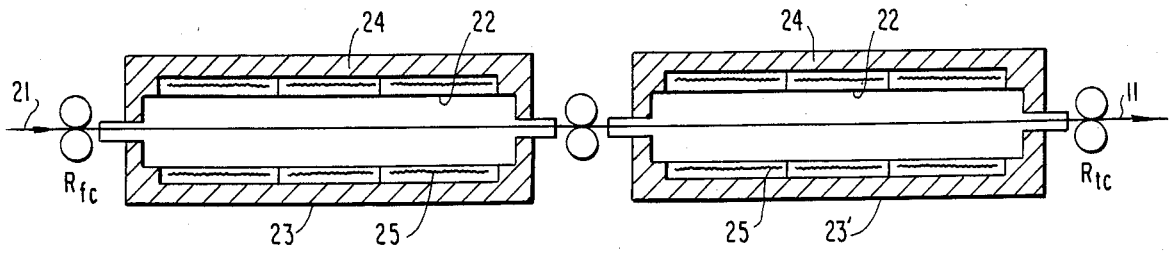

The preoxidized fibers were then pyrolyzed in $N_2$ gas by passage through a pyrolyzing furnace (see FIG. 3) consisting of a first furnace (400° C., retention time: 1 minute) and a second furnace (retention time: 3 minutes). Referring to FIG. 3, the fiber strand is indicated by 21 and each of the first furnace 23 and second furnace 23' is composed of a core tube 22, an insulator 24 and the fibers held at this temperature were found to exhibit the maximum stretch ratios shown in Table 1. In the first pyrolyzing furnace, the fibers were stretched at ratios that were within the range of from 40 to 75% of the measured maximum stretch ratios. The fibers leaving the first furnace were found to have the free shrinkage at 930° C. (the temperature in the second furnace) indicated in Table 1. On the basis of these data, the fibers leaving the first furnace were shrunk in the second furnace to an extent within the range of from 40 to 80% of the measured free shrinkage. The carbon contents in the resulting carbonaceous fibers, the yields of pyrolysis relative to the starting acrylic fiber, and the performance of the carbonceous fibers are shown in Table 2. In Examples 1 to 3 that was within the scope of the present invention, a stable fiber-making operation could be realized without any or very small fluffing or filament breakage problems. The carbonaceous fiber is produced in a high yield and exhibited superior performance within the ranges specified by the fiber of the present invention.

TABLE 1

| | Degree of orientation | Preoxidation | | Preoxidized fiber | | Pyrolysis | | | | | |
|---|---|---|---|---|---|---|---|---|---|---|---|
| | | | | degree of | | 1st furnace | | | 2nd furnace | | |
| Run No. | Of acrylic fiber (%) | time (min) | tension (mg/d) | orientation at 2θ = 25° | specific gravity | a (%) | b (%) | c (%) | d (%) | e (%) | f (%) |
| Example 1 | 91 | 50 | 110 | 80 | 1.37 | 7.2 | 13.2 | 55 | 3 | 5.0 | 60 |
| Example 2 | 91 | 34 | 110 | 78 | 1.30 | 7.2 | 15.1 | 48 | 4 | 6.8 | 59 |
| Example 3 | 91 | 50 | 30 | 70 | 1.38 | 7.2 | 13.2 | 55 | 3 | 5.0 | 60 |
| Comparative Example 1 | 91 | 100 | 110 | 80 | 1.48* | 7.2 | 10.1 | 72 | 3 | 4.5 | 67 |

(Note 1)
a: draw ratio,
b: maximum draw ratio,
c: (draw ratio/maximum draw ratio) × 100
d: shrinkage,
e: free shrinkage,
f: (shrinkage/free shrinkage) × 100
(Note 2)
*outside the scope of the present invention

TABLE 2

| Run No. | State of pyrolysis | Yield of pyrolysis (%) | Properties of carbonaceous fiber: Carbon content (%) | Tensile strength (kg/mm²) | Modulus of elasticity (kg/mm²) | Elongation (%) |
|---|---|---|---|---|---|---|
| Example 1 | stable pyrolysis without filament breakage | 58 | 82 | 355 | 21,800 | 1.63 |
| Example 2 | small amount of filament breakage | 49 | 81 | 270 | 16,800 | 1.61 |
| Example 3 | stable pyrolysis without filament breakage | 58 | 81 | 271 | 18,900 | 1.48 |
| Comparative Example 1 | frequent strand breakage during stretching rendered stable operation impossible | 59 | 82 | 349 | 22,000 | 1.59 |

EXAMPLE 4 TO 8

The preoxidized fiber obtained in Example 1 was pyrolyzed for 5 minutes by passing through the first furnace (520° C. for 1.25 minutes) and the second furnace (890° C. for 3.75 minutes) with the stretch and shrinkage attained in the respective furnaces varied as shown in Table 3. The state of pyrolysis, the yields of pyrolysis and the performance of the carbonaceous fibers obtained are also shown in Table 3.

TABLE 3

| | | Run No. Example 4 | Example 5 | Example 6 | Example 7 | Example 8 |
|---|---|---|---|---|---|---|
| Pyrolysis | | | | | | |
| 1st furnace (%) | a | 6 | 4.5 | 10.4 | 6 | 6 |
| | b | 13.2 | 13.2 | 13.2 | 13.2 | 13.2 |
| | c | 46 | 35 | 80 | 46 | 46 |
| 2nd furnace (%) | d | 3 | 3 | 3.5 | 1.9 | 4.5 |
| | e | 5.0 | 5.0 | 6.5 | 5.0 | 5.0 |
| | f | 60 | 60 | 54 | 38 | 89 |
| Yield of pyrolysis (%) | | 63 | 63 | 63 | 63 | 63 |
| Properties of carbonaceous fiber | | | | | | |
| Carbon content (%) | | 79 | 82 | 82 | 82 | 82 |
| Tensile strength (kg/mm²) | | 328 | 288 | 278 | 309 | 314 |
| Modulus of elasticity (kg/mm²) | | 20,800 | 19,200 | 23,000 | 21,200 | 19,400 |
| Elongation | | 1.58 | 1.50 | 1.21 | 1.46 | 1.62 |

(Note) For the definitions of a through f, see Note 1 of Table 1.

EXAMPLES 9 TO 11

Carbonaceous fibers were produced as in Example 1 except that the temperature in the first pyrolyzing furnace was set to 320° C. (Example 10), 450° C. (Example 9) or 620° C. (Example 11), with the stretch ratio for the first pyrolyzing furnace and the shrinkage for the second furnace being changed as shown in Table 4. In all cases, stable fiber-making operations could be realized without any filament breakage occurring during pyrolysis. As shown in Table 4, a carbonaceous fiber having especially superior performance was obtained in Example 9, which was conducted under especially preferable conditions for the present invention.

TABLE 4

| | | Run No. Example 9 | Example 10 | Example 11 |
|---|---|---|---|---|
| Temperature in 1st pyrolyzing furnace (°C.) | | 450 | 320 | 620 |
| Pyrolysis | | | | |
| 1st furnace | a | 6.76 | 1.7 | 3.0 |

TABLE 4-continued

| | | Run No. Example 9 | Example 10 | Example 11 |
|---|---|---|---|---|
| (%) | b | 14.6 | 3.8 | 6.5 |
| | c | 46 | 46 | 46 |
| 2nd furnace (%) | d | 2.9 | 4.3 | 2.5 |
| | e | 4.9 | 7.2 | 4.2 |
| | f | 60 | 60 | 60 |
| Yield of pyrolysis (%) | | 62 | 64 | 60 |
| Properties of carbonaceous fiber | | | | |
| Carbon content (%) | | 83 | 80 | 84 |
| Tensile strength (kg/mm²) | | 342 | 293 | 298 |
| Modulus of elasticity (kg/mm²) | | 21,500 | 18,200 | 19,500 |
| Elongation (%) | | 1.59 | 1.61 | 1.53 |

(Note)
For the definitions of a through f, see Note 1 of Table 1.

EXAMPLE 12

An acrylic fiber strand having a degree of orientation of 91% at an angle (2θ) of 17° and a decomposition point of 287° C. in air was prepared by repeating the procedures used in Example 1, except that a spinneret nozzle having 6,000 holes of 0.04 mm diameter was employed and that the strand consisted of 6,000 filaments with a fineness of 0.5 denier. The thus-prepared acrylic fiber strand was preoxidized and pyrolyzed as in Example 1 to produce a carbonaceous fiber. As shown in Table 5, this carbonaceous fiber exhibited a superior performance in that it displayed a strength of 250 kg/mm² and an elastic modulus of 15,000 kg/mm².

TABLE 5

| Yield of pyrolysis (%) | Properties of carbonaceous fiber: Carbon content (%) | Tensile strength (kg/mm²) | Modulus of elasticity (kg/mm²) | Elongation (%) |
|---|---|---|---|---|
| 58 | 82 | 377 | 22,300 | 1.69 |

EXAMPLE 13

A carbonaceous fiber was produced by preoxidation and pyrolyzing steps as in Example 1 except that the starting acrylic fiber strand was composed of 6,000 filaments with a fineness of 0.54 denier and was prepared by stretching spun filaments from a spinneret nozzle (0.04 mmϕ×6,000 holes) to a total draw ratio of 14 in saturated steam. The acrylic fiber strand had a degree of orientation of 90.5% at an angle (2θ) of 17°. The specific density of the preoxidized fiber was 1.39. The yield of pyrolysis and the properties of the resulting carbonaceous fiber are shown in Table 6, from which one can see that the carbonaceous fiber produced in accordance with the present invention exhibited superior properties.

TABLE 6

| Degree of orientation of acrylic fiber (%) | Yield of pyrolysis (%) | Properties of carbonaceous fiber: Carbon content (%) | Tensile strength (kg/mm²) | Modulus of elasticity (kg/mm²) | Elongation (%) |
|---|---|---|---|---|---|
| 90.5 | 58 | 82 | 371 | 22,100 | 1.68 |

EXAMPLES 14 AND 15

An acrylic fiber strand having a degree of orientation of 88% at an angle (2θ) of 17° and a decomposition point of 287° C. in air was prepared from a poymer (molecular weight: 65,000) composed of 96% acrylonitrile, 1% itaconic acid and 3% methyl acrylate. The strand consisted of 12,000 filaments with a fineness of 0.8 denier. It was introduced into a preoxidizing furnace (see FIG. 1) via a feed roller Rfp, treated by successive passage through a first heating zone (250° C.×30 minutes) and a second zone (263° C.×24 minutes), and continuously taken up by a take-up roller Rtp.

During the preoxidation, a tension of 105 mg/denier was exerted on those portions of the fiber lying on each roller ($R_1$ through $R_9$), so that the finally obtained preoxidized fiber had a degree of orientation of 81% at an angle (2θ) of 17°. Optical microscopic observation revealed uniform development of blackened areas in a transversal section of each of the fiber at portions lying at each same roller, and this indicated the occurrence of uniform preoxidation reactions. The preoxidized fiber strand thus obtained had a specific gravity of 1.35. It was introduced into a pyrolyzing furnace (see FIG. 2) having an entrance temperature of 330° C. In the furnace an ascending temperature was set so that the temperature of the fiber was raised in a speed of 10/sec to an internal temperature of 880° C., and was taken up by a take-up roller Rtc at such a rate that the residence time at the temperature was 3 minutes. Two samples of carbonaceous fiber were obtained by adjusting the tension as applied between the feed roller Rfc and take-up roller Rtc to 180 mg/denier (Example 15) or 240 mg/denier (Example 14). Each of the samples had the misture regaine, and the tensile strength and modulus of elasticity shown in Table 7. Referring to FIG. 2, 11 is the fiber, 12 is a core tube, 13 is the furnace unit, 14 is an insulator, 15, 15' and 15'' are heaters, 16 is a sealant, and 17 is an inert gas inlet.

The two samples of carbonaceous fiber continuously immersed in an aqueous dispersion of 20% RFL that was prepared by aging at 20° C. for 7 days a mixture of 8.5 parts of resorcin, 4.1 parts of formalin (37% aq. sol.) and 62.6 parts of a rubber latex of a terpolymer composed of 15 parts of vinylpyridine, 15 parts of styrene and 70 parts of butadiene. After being recovered from the RFL dispersion, the fibers were dried at 125° C. for 3 minutes and heated at 220° C. for 1 minute to provide cords with RFL (resorcin-formalin-latex) coatings. For each of the two cord strength to strand strength were determined, and the results are shown in Table 7.

TABLE 7

| | Run No.: Example 14 | Example 15 |
|---|---|---|
| Tension during pyrolysis (mg/denier) | 240 | 180 |
| Carbonaceous fiber strand | | |
| Carbon content (%) | 83 | 83 |
| Moisture regaine (%) | | 3.1 3.3 |
| Tensile strength (kg/mm²) | 328 | 310 |
| Modulus of elasticity (kg/mm²) | 20,800 | 20,000 |
| RFL-treated cord | | |
| RFL deposit (%) | 24 | 24 |
| Cord strength (kg)** | 90 | 83 |
| $\frac{\text{Cord strength}}{\text{Strand strength}} \times 100$ (%) | 63 | 60 |

(Note)
**Cord strength was determined in accordance with JIS-L-1017.

As Table 7 shows, the carbonaceous fibers obtained in Examples 14 and 15 by applying increased tensions during pyrolysis exhibited superior values of moisture regaine, strand strength and strand modulus of elasticity that were within the ranges specified by the present invention. The RFL-treated cords produced from these carbonaceous fibers had adequate amounts of RFL deposit and exhibited high ratios of cord strength to strand strength as calculated from the strand strength values of the fibers.

EXAMPLES 16 AND 17 AND COMPARATIVE EXAMPLES 2 AND 3

Four carbonaceous fiber samples were produced as in Example 14, except that the preoxidized fiber was treated in the pyrolyzing furnace at four different internal temperatures, viz., 650° C., 760° C., 850° C., and 1,100° C. The performance of each of the carbonaceous fibers obtained, the amount of RFL deposit after treatment as in Example 14, the strength of the RFL-treated cords, and the ratio of cord strength to strand strength are shown in Table 8. As one can see from Table 8, the carbonaceous fiber of low water content that was produced in Comparative Example 2 was not sufficiently impregnated with RFL to provide high RFL deposit, and exhibited a low cord strength. In addition, the ratio of cord strength to strand strength was insufficient to ensure a strong bond between the RFL coating and the fiber. The fiber strand obtained in Comparative Example 2 had low strength and a low modulus of elasticity. The products obtained in Examples 16 and 17 satisfied the preferable properties according to the present invention to obtain a higher saturated water content and exhibited especially superior strand performance in impregnation of RFL and produced cords with desired amounts of RFL coatings.

TABLE 8

| | Run No. | | | |
|---|---|---|---|---|
| | Example 16 | Example 17 | Comparative Example 2 | Comparative Example 3 |
| Pyrolyzing temperature (°C.) | 760 | 850 | 650* | 1,100* |
| Carbonaceous fiber strand | | | | |
| Carbon content (%) | 76 | 80 | 73 | 93 |
| Moisture regaine (%) | 6.8 | 5.9 | 8.3 | 0.1 |
| Tensile strength ($kg/mm^2$) | 329 | 351 | 191 | 385 |
| Modulus of elasticity ($kg/mm^2$) | 18,200 | 19,100 | 10,300 | 22,500 |
| RFL-treated cord | | | | |
| RFL deposit (%) | 28 | 25 | 31 | 15 |
| Cord strength (kg)** | 90 | 82 | 52 | 69 |
| $\frac{\text{Cord strength}}{\text{Strand Strength}} \times 100$ (%) | 64 | 62 | 63 | 51 |

(Note)
*See the Note 2 of Table 1.
**See the Note of Table 7.

The moisture regaine of carbonaceous fiber obtained in Examples 1 to 13 and Comparative Example 1 are shown in Table 9.

TABLE 9

| Example No. | 1 | 2 | 3 | 4 | 5 | 6 | 7 | 8 |
|---|---|---|---|---|---|---|---|---|
| Moisture Regaine(%) | 1.9 | 2.0 | 2.0 | 2.0 | 2.0 | 2.0 | 2.0 | 2.0 |
| Example No. | 9 | 10 | 11 | 12 | 13 | (comparative)1 | | |
| Moisture Regaine(%) | 1.6 | 2.2 | 1.5 | 1.9 | 1.9 | 1.9 | | |

While the invention has been described in detail and with reference to specific embodiments thereof, it will be apparent to one skilled in the art that various changes and modifications an be made therein without departing from the spirit and scope thereof.

What is claimed is:

1. A carbonaceous fiber having a carbon content of from 70 to 90% by weight, produced by a method which comprises preoxidizing an acrylic fiber in an oxidizing atmosphere at a temperature of from 10° to 60° C. below the decomposition pont of said fiber, to prepare a preoxidizing fiber having a degree of orientation of not less than 78% at an angle of X-ray diffraction ($2\theta$) of 25° and a specific gravity of from 1.30 to 1.40, pyrolyzing the preoxidizing fiber in an inert gas atmosphere by passing the fiber firstly through a lower temperature zone having a temperature of not higher than 750° C., wherein the preoxidized fiber is stretched in the lower temperature zone to an extent of from 40 to 75% of the maximum draw ratio of the fiber at the temperature of said zone, and then through a higher temperature zone having a temperature of from 750° to 950° C., during the pyrolysis controlling the tension of the fiber so that the change of the fiber length during pyrolyzing is from +16 to −8.8% based on the length of the preoxidized fiber, wherein the fiber is shrunk to an extent of from 40 to 80% of the free shrinkage during pyrolyzing in the higher temperature zone.

2. A carbonaceous fiber as in claim 1, wherein the acrylic fiber comprises a polymer containing at least 93% by weight acrylonitrile.

3. A carbonaceous fiber as in claim 2, wherein the polymer comprises at least 95% by weight of acrylonitrile and from 1% to 5% by weight of methyl acrylate.

4. A carbonaceous fiber as in claim 2, wherein the polymer has a molecular weight of from $1\times10^4$ to $1\times10^5$.

5. A carbonaceous fiber as in claim 2, wherein the individual filament of the acrylic fiber has a fineness of from 0.1 to 1.0 denier.

6. A carbonaceous fiber as in claim 1, wherein the acrylic fiber has a degree of orientation of not less than 85% at an angle of X-ray diffraction ($2\theta$) of 17°.

7. A carbonaceous fiber as in claim 1, wherein the acrylic fiber composes a strand comprising from 100 to 100,000 filaments.

8. A carbonaceous fibers as in claim 1, wherein the preoxidation is conducted at a temperature of from 200° to 300° C.

9. A carbonaceous fibers as in claim 1, wherein the preoxidation is conducted under a tension of from 70 to 200 mg/denier.

10. A carbonaceous fiber as in claim 1, wherein the preoxidized fiber has a degree of orientation of not less than 80% at an angle of X-ray diffraction ($2\theta$) of 25°.

11. A carbonaceous fiber as in claim 1, wherein the lowest temperature of the lower temperature zone is more than 280° C.

12. A carbonaceous fiber as in claim 1, wherein the pyrolysis is conducted under a tension of from 150 to 250 mg/denier.

13. A carbonaceous fiber as in claim 1, wherein the temperature of the lower temperature zone is from 300° to 550° C.

14. A carbonaceous fiber as in claim 1, wherein the fiber is treated at the lower temperature zone until necessary stretching is attained.

15. A carbonaceous fiber as in claim 1, wherein the temperature of the lower temperature zone is raised at a rate of from 1 to 50 per second.

16. A carbonaceous fiber as in claim 1, wherein the pyrolysis in the lower temperature zone is conducted for form 0.1 to 10 minutes.

17. A carbonaceous fiber as in claim 1, wherein the pyrolysis in the higher temperature zone is conducted for from 0.5 to 10 minutes.

18. A carbonaceous fiber as in claim 1, wherein the carbonaceous fiber has a tensile strength of at least 250 kg/mm$^2$, and a modulus of elasticity of at least 15,000 kg/mm$^2$.

19. A carbonaceous fiber as in claim 1, wherein the specific gravity of the preoxidized fiber is not less than 1.35 and the temperature of pyrolyzing is not higher than 900° C.

20. A carbonaceous fiber as in claim 19, wherein the moisture regaine of the carbonaceous fiber is at least 0.5% by weight.

21. A method for producing carbon fiber which comprises preoxidizing an acrylic fiber in an oxidizing atmosphere at a temperature of from 10° to 60° C. below the decomposition point of said fiber to prepare a preoxidized fiber having a degree of orientation of not less than 78% at an angle of X-ray diffraction ($2\theta$) of 25° and a specific gravity of from 1.30 to 1.40, pyrolyzing the preoxidized fiber in an inert gas atmosphere by passing the fiber firstly through a lower temperature zone having a temperature of not higher than 750° C., wherein the preoxidized fiber is stretched in the lower temperature zone to an extent of from 40 to 75% of the maximum draw ratio of the fiber at the temperature of said zone, and then through a higher temperature zone having a temperature of from 750° to 950° C., and during the pyrolysis controlling the tension of the fiber so that the change of the fiber length during pyrolyzing is from +16% to −8.8% based on the length of the preoxidized fiber, wherein the fiber is shrunk to an extent of from 40 to 80% of the free shrinkage during pyrolyzing in the higher temperature zone.

* * * * *